United States Patent [19]

Bührer

[11] 4,278,125

[45] Jul. 14, 1981

[54] SYSTEM FOR HANDLING PATTERN DEVICES IN A MOLDING PLANT FOR THE PRODUCTION OF MOLD HALVES IN MOLD BOXES

[75] Inventor: Erwin Bührer, Schaffhausen, Switzerland

[73] Assignee: Georg Fischer Aktiengesellschaft, Schaffhausen, Switzerland

[21] Appl. No.: 94,115

[22] Filed: Nov. 14, 1979

[30] Foreign Application Priority Data

Nov. 15, 1978 [CH] Switzerland ..... 11715/78

[51] Int. Cl.[3] ..... B22C 25/00

[52] U.S. Cl. ..... 164/412; 164/18; 198/580

[58] Field of Search ..... 164/18, 27, 29, 159, 164/180, 181, 213, 324–328, 412; 198/580, 485, 344

[56] References Cited

U.S. PATENT DOCUMENTS

| | | | |
|---|---|---|---|
| 3,083,421 | 4/1963 | Taccone | 164/314 |
| 4,167,208 | 9/1979 | Buhrer | 164/210 |

*Primary Examiner*—Robert D. Baldwin
*Assistant Examiner*—K. Y. Lin

[57] ABSTRACT

A system for handling pattern devices in molding apparatus for producing mold halves in mold boxes includes a rotatable transfer device having a pair of diametrically opposed tables whereby rotation of the transfer device will periodically shift the tables between a waiting position and an operating position located on opposite sides of the axis of rotation of the transfer device. A conveyor track system is provided having a portion thereof defined by conveyor track elements located on the tables. The conveyor track system includes an upper track section and a lower track section and the overall conveyor track system is formed to define a closed circulation path for the pattern devices.

7 Claims, 9 Drawing Figures

85
a
7
9
b
93
5
57
3
87
85
79
91
1
77

107
69
c
111
109
57
19
56
107
85
91
111
69
a
81
1
109
89
71
45
85
91
56
107
7
83
VI
b
9
VI
69
111
109
d 115
73
23
113
43
57
115
73
117
113

SYSTEM FOR HANDLING PATTERN DEVICES IN A MOLDING PLANT FOR THE PRODUCTION OF MOLD HALVES IN MOLD BOXES

BACKGROUND OF THE INVENTION

The present invention relates generally to molding apparatus and more particularly to a system for handling pattern devices in a molding plant for the production of mold halves in mold boxes. More particularly the invention relates to a system utilizing a swingable transfer device which is provided with two diametrically opposed tables which are moveable between a waiting position and an operating position, with a conveyor track comprising the table which is in the waiting position extending toward opposite sides of the waiting position.

An arrangement of the type above-mentioned is known from German Offenlegungsschrift 28 22 028. Arrangements of this type applied in a molding plant which has a molding station, make it possible to alternatingly provide two pattern devices, for example, for an upper mold part and for a lower mold part. While a molding operation is performed upon that pattern device which has been positioned by means of the table in the operating position, it is possible to perform operations, such as cleaning or applying a cooling iron which rests on the table which is in the waiting position. Furthermore, it is also possible to replace pattern devices on the tables with pattern devices which are on the conveyor track. That pattern device which rests on the table which is in the waiting position can always be moved toward one side of the conveyor track and a new pattern device can be moved onto the table from the opposite side of the conveyor track. Since it is possible to repeat this procedure when the other of the two tables of the transfer device reaches the waiting position the next time, it is possible to exchange pairs of pattern devices without changing the cycle time of the molding plant.

When a foundry which is not intended for production of a single uniform casting must operate with only a single molding machine, this known arrangement has been found not to meet the operating requirements. As is well known, all divisions of a foundry should be capable of operating with as constant an output as possible if optimum results are to be achieved with respect to quality and efficiency. For example, the requirements of molten metal for the foundry should be constant in order to also enable operation of the smeltery with a constant output. Since the requirement for different types of molten metal may vary, variations in the requirements of molten metal for the foundry can be compensated only by bringing the average requirement of the cast molds to an approximately constant value. This is achieved by casting molds with above average molten metal requirements in addition to molds with below average molten metal requirements. Accordingly, the molding plant may be made capable of delivering different molds in a regular sequence.

Similar considerations to those raised above with respect to the requirement of molten metal also apply, for example, to the requirement of cores and the time requirement for cleaning the castings. However, by means of the known device it is not possible to provide the molding plant with the pattern devices in such a manner that variations in the aforementioned factors can be compensated by an appropriately adjusted mold production.

Accordingly, the present invention is directed toward providing an arrangement for handling pattern devices in molding plant with more than two pattern devices, while maintaining the cycle time and predetermined constant sequence.

SUMMARY OF THE INVENTION

Briefly, the present invention may be described as a system for handling pattern devices in molding apparatus for producing mold halves in mold boxes which comprises a rotatable transfer device including a pair of diametrically opposed tables which are periodically shifted between a waiting position on one side of the transfer device and an operating position on the diametrically opposed side of the transfer device. The system includes conveyor track means having a portion thereof defined by conveyor track elements on the tables of the rotatable transfer device so that when either of the tables is in the waiting position, the conveyor track elements thereon will operate to define a portion of the conveyor track means of the invention. The conveyor track means will extend toward opposite sides of the table in the waiting position and, in accordance with an important aspect of the present invention, the conveyor track means is formed to define a closed circulation path.

By utilization of the invention it is possible to keep in operation not only the pattern devices which are on the tables of the transfer device but also several pairs of additional pattern devices. Individual pattern devices may be supplied periodically and in a predetermined constant sequence to the molding plant by continuously supplying the pattern devices to the waiting position of the tables through the closed circulation path in a constant direction of movement. The number of the pattern devices which are in operation can be adjusted equally well to the requirements of the foundry operation as the number of the mold halves to be produced per cycle.

Since it is possible to freely select the number of the various periodically circulating pattern devices and the number of the mold halves to be produced on the individual pattern devices, the invention facilitates maximum adjustment of the molding division to the requirements of the other foundry divisions. By planning the production, the pattern devices can be provided to the molding division in such a manner that it is possible to essentially avoid the variations in the requirement of molten iron and in the man-hours required for the production of the cores in the core making division and for covering the latter in the molding division. Furthermore, variations in the man-hours for cleaning the castings, and variations in the load of specific machines and devices may also be avoided. It is thereby further possible to avoid variations of the core portion in the used or old sand or excessive variations in the temperature of the used sand.

In accordance with a preferred embodiment of the invention, the circulation path is closed by means of a second conveyor track which operates in the opposite direction to the first conveyor track containing the table, and by means of at least two transfer devices which connect the two conveyor tracks to each other.

The second conveyor track is preferably arranged parallel and beneath the first conveyor track and the transfer devices are constructed as lifting devices. This facilitates the free access to the table which is in the waiting position and to the pattern device resting on this table.

If the upper conveyor track has extensions on both ends which extend outwardly of the lifting devices, as is provided in a preferred embodiment of the invention, the pattern devices to be placed into operation can be made available on one side and the pattern devices to be taken out of operation can be picked up on the other side of the roller conveyor. Accordingly, it is easily possible to replace pattern devices within the cycle time. This makes it possible to advantageously use in a molding and casting plant for the production of only one, or only a few mold halves, a certain pattern device for carrying out small or supplemental current orders, or for testing new pattern devices.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
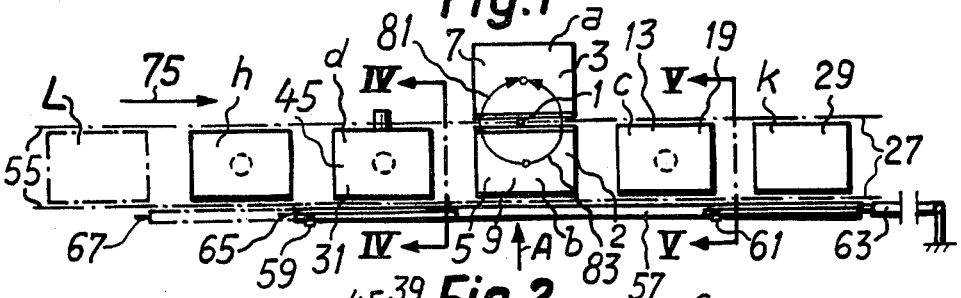
FIG. 1 is a schematic representation showing in plan view a first embodiment of the system of the invention which is capable of handling a maximum of six pattern devices.
Figure 2:
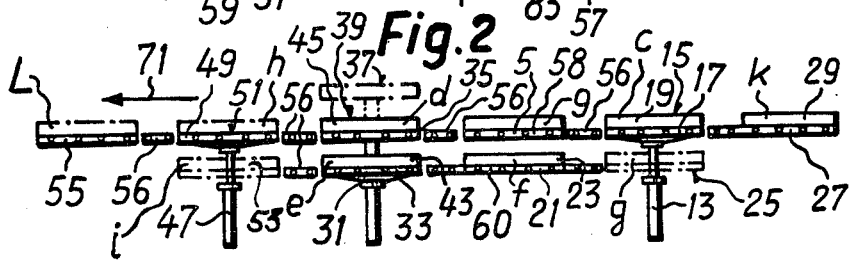
FIG. 2 is a schematic representation taken in the direction of arrow A of FIG. 1 showing the system of the invention without a push rod and push rod guide.
Figure 3:
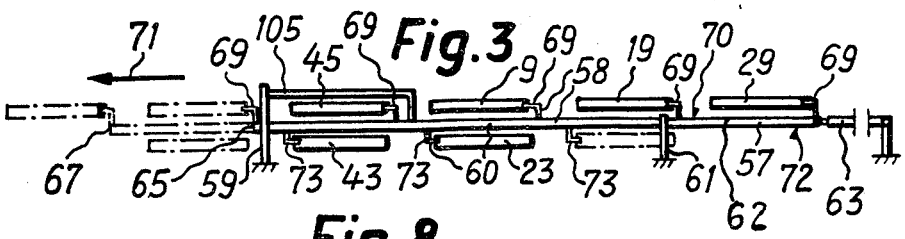
FIG. 3 is a schematic representation of the system showing a push rod including push rod guide taken in the direction of arrow A of FIG. 1.

A system in accordance with the invention depicted in FIGS. 1–3 includes a transfer device 1 which can be swung about a vertical axis and which is provided with diametrically opposed tables 3 and 5. Table 3 carries a pattern device 7 which, when in an operating position a is located at a molding plant (not shown) e.g. beneath a sand filling device. The table 5 is located diametrically opposite the table 3 in a waiting position at station b outside of this molding plant and table 5 carries a pattern device 9.

A lifting device 13 is illustrated in the raised position 15 and includes a roller conveyor 17 supporting a pattern device 19. A stationary roller conveyor 21 carries a pattern device 23 and is arranged beneath the table 5. The lifting device 13 can be lowered into the position 25 which corresponds to the level of a stationary roller conveyor 21. A roller conveyor portion 27 carries a pattern device 29.

A lifting device 31 has two roller conveyors 33 and 35 which are arranged one above the other. In the raised position 37 of the lifting device 31, the roller conveyor 33 is level with the table 5. In the lowered position 39, it is level with the stationary roller conveyor 21, while the roller conveyor 35 is level with the table 5. Accordingly, the difference in the levels between the roller conveyors 33 and 35 corresponds to a lifting height 41 (see FIG. 4).

The roller conveyor 33 carries a pattern device 43 and the roller conveyor 35 carries a pattern device 45. A lifting device 47 including a roller conveyor 49 is illustrated in the raised position 51 which corresponds to the level of the table 5 and it can be lowered into a position 53 which corresponds to the level of the stationary roller conveyor 21. A stationary roller conveyor 55 is assigned to the lifting device in the level of the table 5.

Roller conveyors 56 which are arranged next to the lifting devices are rigidly supported in a manner which is not shown and they serve to bridge the gaps between the roller conveyors 17 of tables 5 or 3, and between roller conveyors 35, 49, 55 and 33.

In FIGS. 1 and 3, a push rod 57 with push rod guides 59 and 61 is schematically illustrated. A stationary cylinder 63 can move the push rod 57 from a position 65 into the position 67 and vice-versa. During the movement of the push rod 57 from the position 65 into the position 67, the pivoted levers 69 arranged on the upper side of the push rod 57 can engage the pattern devices 29, 19, 9 and 45 and can advance the pattern devices by one station in the direction of arrow 71. During the movement of the push rod 57 from the position 67 into the position 65, the pivoted levers 73 arranged at the bottom side of the push rod 57 can engage the pattern devices 43 and 23 and can advance the pattern devices by one station in the direction of arrow 75.

Figure 6:
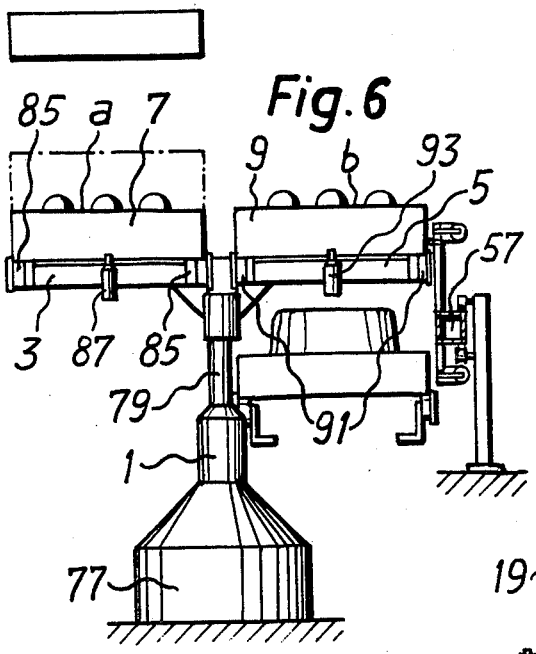
FIG. 6 is a schematic elevation taken partially in section along the line VI—VI of FIG. 7.
Figure 7:
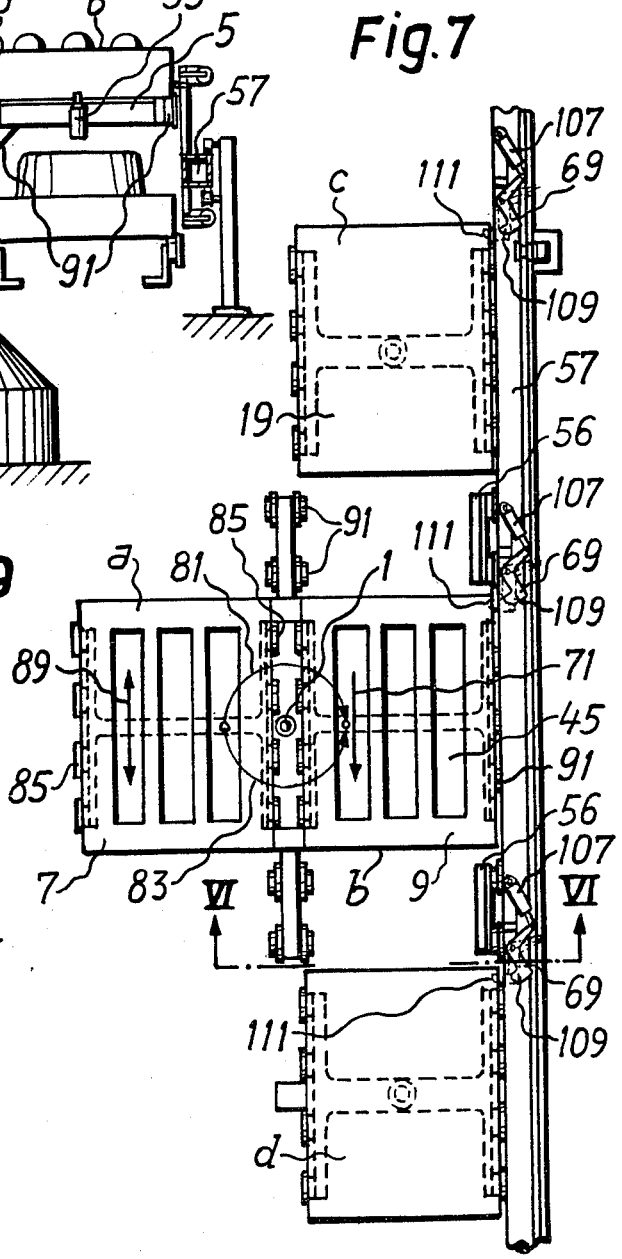
FIG. 7 is a schematic plan view showing a portion of the system of FIG. 1 in an enlarged scale.

In FIGS. 6 and 7, wherein the transfer device 1 is shown in an enlarged scale, a housing 77 has a column 79 supported therein so as to be rotatable through an angle of 180° in the direction of arrows 81 or 83. The tables 3 and 5 are rigidly connected to the column 79. The roller conveyor 85 is assigned to table 3. The roller conveyor 85 carries a pattern device 7 which can be locked or released by means of a locking cylinder 87. The table 5 has a roller conveyor 91 which carries a pattern device 9, and a locking cylinder 93. The locking cylinders 87 and 93 are actuated prior to each rotation of the transfer device 1 in such a manner that they lock the pattern devices resting on the tables 3 and 5 and are retracted after each performed rotation in order to release the pattern devices.

Figure 4:
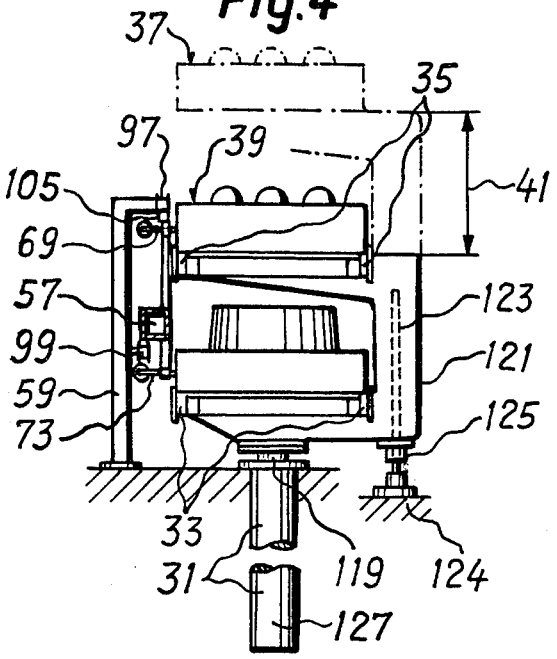
FIG. 4 is a schematic elevation showing a lifting device with two roller conveyors, one arranged above the other, taken partially in section along the line IV—IV of FIG. 1.
Figure 5:
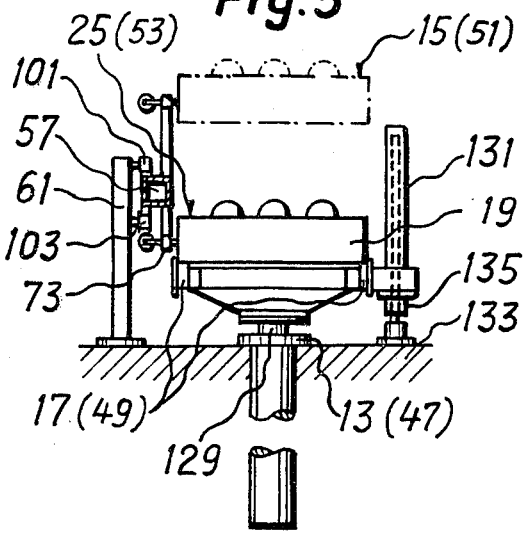
FIG. 5 is a schematic elevation showing a lifting device with a roller conveyor taken partially in section along the line V—V of FIG. 1.

FIGS. 6 and 7 further show a push rod 57 which is guided in push rod guides 59 and 61 (see also FIGS. 3 to 5). A straight edge or ruler 105 is rigidly connected to the push rod 57. The rollers 97 and 99 of the push rod guide 59 have wheel flanges and, therefore, they secure the push rod 57 against rotation, while the push rod guide 61 merely guides the push rod 57 in a roller 103 with wheel flanges and a smooth roller 101.

The pivoted levers 69 (see FIG. 7) can be swung by means of the cylinder 107 from a position 109 into a position 111 in which the pivoted levers 69 engage the pattern devices 29, 19, 9 and 45, while they release the pattern devices in the swung-out position 109.

Figure 9:
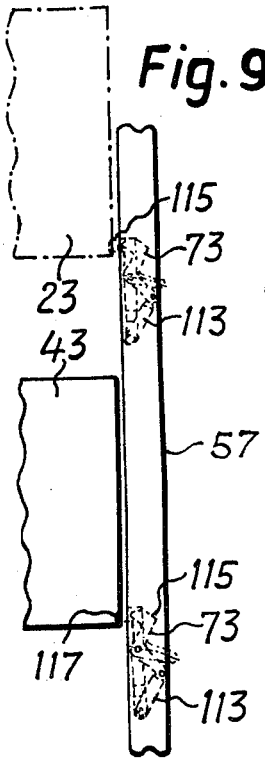
FIG. 9 is a schematic plan view of a section of a push rod according to the system of FIGS. 1–7 which does not show a controlled pivoted lever on the upper side.

FIG. 9 shows the pivoted levers 73 which are arranged underneath the push rod 57 and which can be swung by means of the cylinders 113 from a position 115 into a position 117 in which they engage the pattern devices 43 and 23.

FIG. 4 shows the lifting device 31 which carries a roller conveyor 33 and a roller conveyor 35 on its piston rod 119 through a stirrup 121. The stirrup 121 is secured against rotation in a guide 125 by means of a rod 123 which is supported on a foundation 124. The lifting height 41 is limited by the cylinder 127.

FIG. 5 shows the transfer device 13 or 47. The piston rod 129 carries a roller conveyor 17 or 49 on which there is supported, for example, pattern device 19. The lifting device 13 or 47 can be raised from a lowered position 25 into a position 15. Through a guide 135, the roller conveyors 17 or 33 are secured against rotation by means of a rod 131 which is supported by a foundation 133.

It should be noted from the foregoing that the roller conveyors 17, 56, 35 and 56, together with the roller conveyor 91 of the table 5 which is in the waiting position, form an upper conveyor track which is generally denoted by reference numeral 58 in FIG. 2. On the other hand, roller conveyors 56, 33, 56 and 31 form a lower conveyor track denoted by reference numeral 60. Together with the transfer devices 13 and 47 and their roller conveyors 17 and 49, these conveyor tracks 58 and 60 form a closed circulation path.

In the operation of the system shown in FIGS. 1–7 and 9 four different pattern devices 7, 9, 19 and 23 may be alternatingly molded in the molding plant. Accordingly, two complete molds, i.e., four mold halves, can be produced on this molding plant which corresponds, for example, to the one illustrated in German Offenlegungsschrift 2822028. It is assumed in this connection that the pattern devices 7 and 9 form the upper mold part and lower mold part of one mold and that the pattern devices 19 and 23 form the upper mold part and the lower mold part of the other mold.

The pattern device 7 is in the position a, the pattern device 9 in the position b, the pattern device 23 in the position f and the pattern device 19 in the position g. The two lifting devices 31 and 13 are in the lowered position 39 and 25, respectively. After molding the pattern device 7, the transfer device 1 is swung and moves the pattern device 9 to the position a and the pattern device 7 to the position b. Simultaneously, the lifting device 31 is lifted into the position 37 and the lifting device 13 including the pattern device 19 is lifted into the position 15. While the pattern device 9 is molded, the pattern devices 7 and 19 are initially moved into the positions d and b in the direction of arrow 71.

After swinging the pivoted lever 69 into the position 109, the lifting device 31 is lowered into the position 39 and the lifting device 13 into the position 25. By actuating the cylinder 113, the pivoted levers 73 are swung into the position 117 and engage the pattern devices 7 and 23. By reversing the cylinder 63, the pattern device 23 is moved in the direction of arrow 75 in the position g and the pattern device 7 in the position f.

Subsequently, the pivoted lever 73 is swung into the position 115. The lifting device 31 is now raised into the position 37 and the lifting device 13 including the pattern device 23 is lifted into the position 15. Simultaneously, the transfer device 1 is swung and moves the pattern device 19 into the position a and the pattern device 9 into the position b. While the pattern device 19 is molded, the pattern devices 9 and 23 are moved into the positions d and b, respectively, in the direction of arrow 71. Subsequently, the lifting device 31 including the pattern device 9 is lowered into the position 39 and the lifting device 13 into the position 25.

The pattern devices 7 and 9 are moved into the position g and f in the manner already described. Subsequently, the lifting device 31 is lifted into the position 37 and the lifting device 13 including the pattern device 7 is lifted into the position 15, while, simultaneously, the transfer device 1 is swung and the pattern device 23 is brought into the position a and the pattern device 19 into the position b. While the pattern device 23 is molded, the pattern devices 19 and 7 are are moved into the positions d and b, respectively. By lowering the lifting device 13, the pattern device 19 is moved into the position e, while, simultaneously, the lifting device 13 is lowered into the position 25.

Subsequently, the pattern devices 9 and 19 are moved into the positions g and f, respectively. While the lifting device 31 is lifted into the position 37 and the lifting device 13 including the pattern device 9 is lifted into the position 15, the transfer device 1 is swung and moves the pattern device 7 into the position a and the pattern device 23 into the position b. While the pattern device 7 is molded, initially the pattern devices 23 and 9 are moved into the positions d and b, respectively, and, subsequently, the lifting device 31 including the pattern device 23 is lowered into the position 39 and the lifting device 13 into the position 25. After the pattern devices 19 and 23 have been moved into the positions g and f, the pattern devices 7, 9, 19 and 23 will have traveled a circulation period and will have again assumed their original positions.

As will be apparent from the foregoing, with the manner of operation described, the individual pattern devices are molded only a single time during each cycle on the circulation path. If it is assumed that the pattern devices 7 and 9 are to be used to produce a first mold with an above average requirement of molten metal, the pattern devices 19 and 23 may be used to produce a second mold which has a requirement of molten metal which is below a predetermined average value. When casting these immediately succeeding molds, it is possible to achieve after each second mold a compensation or an approximation to the average requirement mold representing a constant requirement of molten metal of the foundry.

However, it is easily possible to produce within one cycle of the pattern devices, for example, several first molds on the pattern devices 7 and 9 and, subsequently, alternatingly only one second mold on the pattern devices 19 and 23. In this case, the pattern devices 7 and 9 remain on the transfer device 1 for a repeated molding operation before they are moved in the direction of arrow 71 through the position d. The possibilities of compensation can obviously be increased when it is assumed that the second mold deviates more from the average value of molten metal than the first mold.

According to another manner of operation of the system, six different pattern devices 7, 9, 45, 43, 23 and 19 may be alternatingly provided on the molding plant, wherein the resulting mold halves can be combined to three different molds. It is assumed in the following description that the pattern device 7 is in position a, the pattern device 9 in position b, the pattern device 45 in position d, the pattern device 43 in position e, the pattern device 23 in position f and the pattern device 19 in position g. Furthermore, the lifting device 31 is not actuated and remains in the lowered position 39. The lifting device 47 is in the lowered position 53. This manner of operation differs from the one previously described only in that, instead of two pattern devices, three pattern devices, for example, 19, 9 and 45 are always advanced by one station in the direction of arrow 71, and that, furthermore, instead of lifting device 31, the lifting device 47 including the pattern device 45 is lowered from the raised position 51 into the position 53. Furthermore, instead of two pattern devices, three pattern devices, for example, 45, 43 and 23 are advanced by one station in the direction of arrow 75. Finally, simultaneously with rotating the transfer device 1 which, for example, carries the pattern device 7 and 19, the lifting device 47 is raised into the position 51 and the lifting device 13 including the pattern device 23 is raised into the position 15.

If a pattern change is to be performed, for example, when four pattern devices are in circulation, the lifting device 31 is not lowered when the pattern device to be taken out of operation arrives on the lifting device 31. Since the pivoted lever 69 corresponding to the position d engages the pattern device resting on the lifting device 31 during the next movement in the direction of arrow 71, this pattern device is necessarily moved initially into the position h through the lifting device 47 which is in the raised position and, subsequently, into the position L during the subsequent pattern circulation. After the performance of three cycles, the pivoted lever 63 corresponding to position k is swung into the position 111 by actuating the corresponding cylinder 107 and, in the fourth cycle, moves the pattern device 29 to be put into operation from the position k into the position c whereby the pattern change is performed.

When six different pattern devices are in circulation, the change is performed in such a manner that the lowering movement of the lifting device 47 is interrupted for one cycle and, after five cycles have been performed, the pivoted lever 69 of the pattern device 29 engages the latter and moves the pattern device 29 from the position k into the position c in the sixth cycle.

Figure 8:
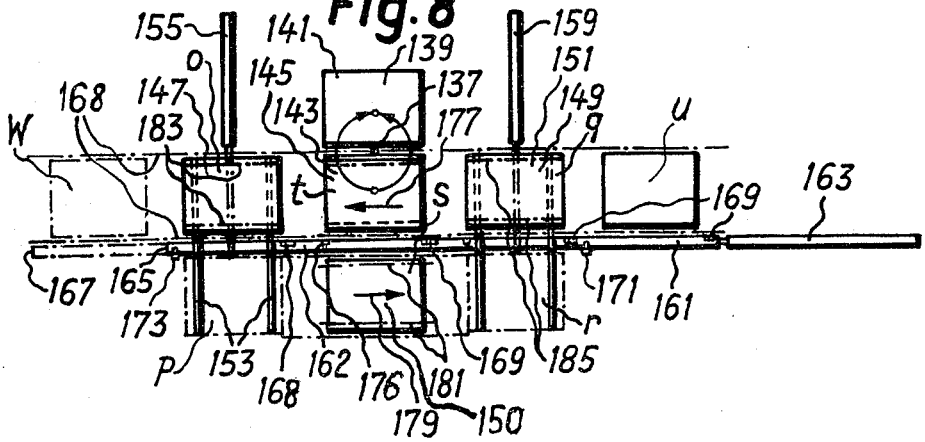
FIG. 8 is a schematic representation showing in plan view a second embodiment of the system of the invention capable of handling a maximum of four pattern devices.

FIG. 8 is a schematic illustration of a modified embodiment of the invention. A transfer device 137 has a table 139 including a pattern device 141 and a table 143 including a pattern device 145. Both pattern devices are supported by roller conveyors 187 which are carried by the tables.

On both sides of the table 143, a carriage 147 is provided in the position o and a carriage 149 in the position g. A pattern device 151 is carried by the carriage 149 through a roller conveyor 185. The carriage 147 carrying roller conveyor 183 can be moved on a rail 153 extending transversely relative to the axis of the roller conveyor from a position o into a position p and vice-versa by actuating the cylinder 155.

On the other side, the carriage 149 can be moved on a rail 157 extending parallel to the rail 153 from a position q into a position r and vice-versa by actuating the cylinder 159. A push rod 161 can be moved from a position 165 into a position 167 and vice-versa by means of a cylinder 163. The push rod 161, which as already described, is supported in guides 171 and 173, has actuatable pivoted levers 169 which engage the pattern devices 145, 151 in order to be able to move these pattern devices from the positions U and q into the positions o and t in the direction of arrow 177.

The push rod 161 is further provided with actuatable pivoted levers 175 which engage, for example, the pattern device 150 in order to be able to move the latter from the position s into the position r in the direction of arrow 179. In the position p and r, the roller conveyors 183 and 185 of the carriages 147 and 149 coincide with the roller conveyor 181. In this case, the roller conveyors 183, 187, 185 and 181 form parts of two conveyor tracks 168 and 176 which extend parallel to each other.

While the system in accordance with FIGS. 1–7 and 9 has lifting devices 13, 31, 47 which can be used as transfer devices, in the system according to FIG. 8, the carriages 147, 149 serve as transfer devices. The manner of operation of the arrangement according to FIG. 8 is identical with that already described in connection with the system of FIGS. 1–7 and 9. Together with the carriages 147 and 149, the conveyor tracks 168, 176 represent a closed circulation path for the pattern devices.

The arrangement according to the invention is not limited to the transfer devices illustrated in FIGS. 1–9, and it is also possible to use, for example, known transfer devices which hold the pattern devices by means of clamping means.

While specific embodiments of the invention have been shown and described in detail to illustrate the application of the inventive principles, it will be understood that the invention may be embodied otherwise without departing from such principles.

What is claimed is:

1. A system for handling pattern devices in molding apparatus for producing mold halves in mold boxes comprising: a rotatable transfer device including a pair of diametrically opposed tables which are periodically shifted between a waiting position and an operating position; and conveyor track means including a portion thereof defined by one of said pair of tables which is in said waiting position; said conveyor track means being formed to define a closed circulation path extending toward opposite sides of said table in said waiting position; said conveyor track means comprise a first and a second conveyor track, wherein said second conveyor track operates to convey said pattern devices in a direction opposite to the direction of said first conveyor track, wherein said second conveyor track contains said table at said waiting position, and wherein said system further includes at least two transfer devices which connect said first and said second conveyor tracks with each other.

2. A system according to claim 1 wherein said said first and said second conveyor tracks are formed by roller conveyors having operatively associated therewith a joint pushing device for moving said pattern devices, said pushing device being effective in each of two conveying directions.

3. A system according to claims 1 or 2 wherein said second conveyor track is arranged beneath and parallel with said first conveyor track and wherein said transfer devices are constructed as lifting devices.

4. A system according to claim 3 wherein a third lifting device is provided between one of said two lifting devices and said rotatable transfer device on the side of said rotatable transfer device where said waiting position is located, said third lifting device being provided with two conveyors which are arranged one above the other at a spacing equivalent with the lifting height of said third lifting device.

5. A system according to claims 1 or 3 wherein on either side of said waiting position of said rotatable transfer device there is arranged at least one carriage which may be moved on rails extending between said first conveyor track and said second conveyor track, said second conveyor track being arranged at the same level as said first conveyor track.

6. A system according to claim 2 wherein said push device is provided with a push rod having controlled pivoted levers which engage said pattern devices in order to move said pattern devices in one direction, with additional controlled pivoted levers which engage said pattern devices to move said pattern devices in an opposite direction being also provided.

7. A system according to claim 2 wherein said first conveyor track includes extensions on both sides and outside of said rotatable transfer device, said extensions forming at least one additional position for said system.

* * * * *